United States Patent [19]

Bergeron, Jr.

[11] Patent Number: 4,602,676

[45] Date of Patent: Jul. 29, 1986

[54] HEAT TRANSFER AND BUILDING SUPPORT SYSTEM

[75] Inventor: Hervin J. Bergeron, Jr., Opelousas, La.

[73] Assignees: Stephen J. Ledet, Jr., Opelousas; James Donald Elder, Sulphur, both of La.

[21] Appl. No.: 239,982

[22] Filed: Mar. 3, 1981

Related U.S. Application Data

[63] Continuation-in-part of Ser. No. 54,659, Jul. 3, 1979, Pat. No. 4,505,325, and a continuation-in-part of Ser. No. 135,073, Mar. 28, 1980, abandoned, and a continuation-in-part of Ser. No. 230,375, Feb. 2, 1981, Pat. No. 4,440,343.

[51] Int. Cl.[4] ..... F28D 17/00

[52] U.S. Cl. ..... 165/45; 62/260; 165/48.2; 126/430

[58] Field of Search ..... 165/45, 48.2; 126/400, 126/430; 62/260

[56] References Cited

U.S. PATENT DOCUMENTS

| | | | |
|---|---|---|---|
| 2,167,878 | 8/1939 | Crawford . | |
| 2,559,870 | 7/1951 | Gay . | |
| 2,584,573 | 2/1952 | Gay . | |
| 2,726,593 | 12/1955 | Lahti | 52/221 X |
| 2,780,415 | 2/1957 | Gay . | |
| 2,793,509 | 5/1957 | Keen . | |
| 2,828,681 | 1/1958 | Smith | 62/419 X |
| 2,829,504 | 4/1958 | Schlichtig . | |
| 3,236,061 | 2/1966 | Wells . | |
| 3,236,294 | 2/1966 | Thomason . | |
| 3,354,947 | 11/1967 | McKinnon . | |
| 3,369,541 | 2/1968 | Thomason . | |
| 3,412,728 | 11/1968 | Thomason . | |
| 3,415,024 | 12/1968 | Kotlarz . | |
| 3,527,921 | 9/1970 | Voglesonger | 165/45 |
| 3,534,810 | 10/1970 | Limoni . | |
| 3,758,748 | 9/1973 | Reid . | |
| 3,874,441 | 4/1975 | Duchene . | |
| 3,922,832 | 12/1975 | Dicker . | |
| 3,983,929 | 10/1976 | Thomason et al. . | |
| 4,010,731 | 3/1977 | Harrison | 126/400 |
| 4,037,583 | 7/1977 | Bakun | 165/45 X |
| 4,051,891 | 10/1977 | Harrison . | |
| 4,051,999 | 10/1977 | Granger et al. | 126/400 |
| 4,054,246 | 10/1977 | Johnson | 126/429 |
| 4,089,142 | 5/1978 | Kachadorian . | |
| 4,121,563 | 10/1978 | Gold . | |
| 4,127,973 | 12/1978 | Kachadorian | 165/49 |
| 4,139,321 | 2/1979 | Werner | 126/400 |
| 4,173,304 | 11/1979 | Johnson . | |

*Primary Examiner*—Albert W. Davis, Jr.
*Attorney, Agent, or Firm*—John F. Sieberth

[57] ABSTRACT

The system is composed in essence of an aggregate mass through which air can be blown, film sheeting enveloping the mass, and apparatus for directing a flow of air from the interior of a home or other building structure through the aggregate mass and back into the interior. The slab or floor of the home rests on and is supported in part by the enveloped mass. The aggregate mass is a relatively poor conductor of heat and thus heat transfer occurs mainly between the air flowing through the mass and the slab or floor above the mass and the ground below the mass. Apparatus for recovering waste heat within the home is described. Desirably, the system is used in conjunction with a solar collector. The system with or without the solar collector reduces substantially the energy required to heat and cool the home.

32 Claims, 21 Drawing Figures

HEAT TRANSFER AND BUILDING SUPPORT SYSTEM

REFERENCE TO RELATED APPLICATIONS

This is a continuation-in-part of my prior co-pending applications Ser. No. 54,659, filed July 3, 1979 now U.S. Pat. No. 4,505,325, granted Mar. 19, 1985, Ser. No. 135,073, filed Mar. 28, 1980 abandoned, and Ser. No. 230,375, filed Feb. 2, 1981 now U.S. Pat. No. 4,440,343, granted Apr. 3, 1984.

BACKGROUND OF THE INVENTION

1. Field of the Invention

The present invention relates to air circulation systems for generally enclosed structures such as homes having a floor and wall portions.

The present invention more particularly relates to an improved heat transfer an air circulation system for homes and like construction wherein use is made of a non-heat conductive aggregate structural circulation medium capable of both supporting the home and transmitting circulating air from the home through the air spaces in the aggregate medium to enable heat transfer to take place between the air and the adjacent underlying soil mass and between the air and the adjacent overlying slab or floor of the home.

2. General Background and Prior Art

In homes and other like constructions, fossil fuels or other energy is spent usually in the form of generated electricity for heating and cooling of the home. The average home requires energy which is ever shrinking and ever more expensive for its comfortable climate control.

There is a need for a more efficient system for heating and cooling the home which will allow it to be more efficiently and less expensively temperature controlled without the excessive use of electricity, fossil fuels or other consumed energy.

Most homes are of a slab type construction, meaning that the home sits on a probably four to six inch thick mass of concrete, which is poured on the ground (and some distance below in many cases) providing a structural support for the home. Other secondary support such as piling can communicate with the slab to provide a structural base which will not sink under the load of the home and the slab itself.

In most climates, the temperature in the ground under the slab differs from the temperature of the atmosphere around the home and is at or close to the temperature desired in the home. For example, during the heat of the day the soil beneath the home is usually many degrees cooler. Further, in the winter the outside air is usually much cooler than the ground a few inches or feet below the ground surface. Indeed, it is recognized that a "frost line" exists below which pipes and other matter will not freeze.

In summer, a few inches or feet below the slab of the home cooler temperatures exist than in the atmosphere around the home. Usually, the earth or soil at the frost line has a relatively constant temperature all year long.

It would thus be desirable to circulate air through a medium provided blow the home and return it to the inside of the home to either supplement the existing cooling system in the home or provide the total cooling system therefor. In winter, heating could be accomplished by circulating air taken from the home to the relatively constant temperature earth, and returning that air to the interior of the home.

Many devices have been patented, which have attempted to solve the problem of air circulation and climate control within homes and similar inhabitable constructions. Many of these devices have provided a medium of some sort beneath the ground through which air can be circulated and heat transfer effected.

Some prior art devices require complex structural support for the home or construction. Others do not have adequate detention time provided by their circulation medium for the circulated air to effect proper heat transfer. Still, others require deep excavations or complex equipment, or both, and thus would be difficult and expensive to install.

In the heat transfer media provided or suggested by some prior art devices/systems, heat conductive material is used, allowing premature heat transfer to occur before air currents reach the underlying earth. Thus, "hot spots" are created in the circulation medium.

Some systems suffer from undesirable heat transfer to or from the surroundings.

Heating or cooling of the floor area which contacts sensitive human extremities (as feet) is not achieved by prior devices without inefficient and expensive supplemental conventional heating or cooling.

GENERAL DISCUSSION OF THE PRESENT INVENTION

The present invention solves the prior art problem and shortcomings in a very simple and inexpensive manner by providing an effective and workable heat transfer thermal cap system for use under the floor or slab portion of a home to be heated and cooled. In addition, this invention provides an air circulation system for use with generally enclosed structures, such as homes and the like having at least enclosing walls and roof. More particularly, this invention in one of its forms provides a support and temperature regulating structural system for use with a generally enclosed structure having at least enclosing walls, a roof and a slab/floor, which structural system comprises (a) an aggregate mass having void air spaces therein enabling air to pass through said mass, (b) film sheet enveloping said mass for preventing water flow into said mass from the exterior, and (c) means adapted to direct a flow of air from the interior of said enclosed structure through a substantial portion of said mass and thence back into the interior of said structure. Such aggregate mass is further characterized in that the mass together with its film sheet envelope rests upon and is supported by the ground at the site of the structure and is adapted to communicate with and support a substantial portion of the slab/floor. Preferably at least 30 percent and most preferably at least 50 percent of the area of the underside of the slab/floor overlies the aggregate mass. Another important characteristic of the aggregate mass is that it is substantially non-heat conductive.

Preferably the system further includes footings extending downwardly into the ground at the site of said structure, said footings being positioned and adapted to support the underside of said slab/floor at least around the perimeter thereof. In another preferred embodiment the system further includes thermal insulation material extending downwardly into the ground at the site of said structure, said material being positioned around the perimeter of the site of said structure and adapted to thermally insulate said mass around the perimeter thereof. For best results this insulation material should extend down at least to the frost line, if any.

The means referred to in (c) above preferably include perforated conduit means positioned around or in the perimeter portion of said mass for collecting air from the enveloped aggregate mass and transferring the collected air to the interior of the generally enclosed structure at peripheral locations in said interior above but in proximity to the floor area thereof. Such perforated conduit means may be arranged in various ways. For example, they may comprise a plurality of independent air return lines perforated along a portion of their respective lengths mounted in the aggregate mass at a plurality of locations around the perimeter of the mass. In another form, the perforated conduit means comprise a continuous perforated header mounted around the perimeter of the aggregate mass.

In the preferred embodiments, the means referred to in (c) above further include air distributor means positioned at an interior portion of said mass for distributing air from the interior of the generally enclosed structure into said mass in opposed directions toward said perforated conduit means. Several types of air distributor means have been found particularly desirable. In one form the air distributor is simply a circular opening in an interior portion of the slab/floor below which is mounted a screen box or like device adapted to prevent the aggregate mass from plugging the opening in the slab/floor. Another preferred form of air distributor means is an elongate perforated plenum positioned within the aggregate mass. The plenum is fed by one or more conduits receiving the air from the interior of the enclosed structure. Still another preferred type of air distributor means is a perforated plenum in the form of a closed loop fed by a plurality of conduits which likewise receive the air from the interior of the generally enclosed structure. A blower is used for circulating the air between the enclosed structure interior and the void air spaces within the aggregate mass and thence back into the interior.

It can thus be seen that a void air space is provided directly under at least a substantial portion of the slab/-floor, this space being occupied and partially filled by a relatively non-heat conductive, structural air circulation medium or aggregate mass. In other words, this structural aggregate material is positioned under at least a substantial portion of the slab or floor of the structure so that the material also communicates with the underlying earth. The aggregate material provides structural support to the home or like construction since its uppermost portion communicates with and supports at least a portion of the slab or floor of the enclosed structure. In addition, the aggregate material provides baffled flow channels or paths through which the air flows under the urging of the blower. Since the aggregate material is relatively non-heat conductive, heat exchange principally occurs between the flowing air and its adjacent boundaries—i.e., the overlying slab or floor and the underlying supportive earth.

As noted above, a water barrier film sheet envelope surrounds the aggregate mass and prevents water flow into the aggregate mass from the surrounding area. The envelope also assists in confining the air flow within the aggregate mass.

Most preferably, the plastic sheeting positioned above the mass and the plastic sheeting positioned below the mass not only envelop the aggregate mass itself but the perforated conduit means and the air distributor means as well, so that the envelope is sealed except for openings for the conduits or passages carrying the air into and out of the aggregate mass. In practice, it is particularly preferred to extend the edges of the upper and lower plastic sheeting down into the trench for the footings. In this way, the poured concrete footings press and seal the edges against the adjacent ground surfaces.

The air return lines carrying the flowing air from the perimeter portions of the aggregate mass to the peripheral locations of the interior of the generally enclosed structure may have independent flow control means associated therewith. Such flow control means may be of various types. For example, they may comprise adjustable louvers or dampers to control the volume of air flow from the respective discharge ports. Preferably, the flow control means comprise a suitable length of perforated pipe communicating with the air return lines, the perforated pipe being mounted in or adjacent to the aggregate mass. When the system utilizes a continuous perforated header mounted around the perimeter of the mass for collecting the return air, balanced air flow is readily achieved without using louvers or the like, although such may be used if desired.

A feature of this invention is that in regions where a frost line exists, the aggregate mass of relatively non-heat conductive, structural air circulation material provided under the slab portion of the structure communicates with the frost line area either directly or indirectly. In areas where the frost line is relatively near the ground surface, sufficient earth may be excavated so that the aggregate mass itself extends down to the frost line area. Alternatively, the aggregate mass may communicate with the frost line region indirectly by means of the supportive earth layer existing between the aggregate mass and the frost line region, and in this case it matters not how deep or shallow the frost line region may be. Thus in the practice of this invention it is not necessary to excavate deeply into the earth. In fact, in regions having moderate climates such as the Gulf Coast region of the United States it is possible and indeed preferable to simply clear the site of natural growth, debris and the like and place the aggregate mass onto the cleared and graded ground site without excavation except for trenches to accommodate the footings and thermal insulation.

In the method of operation, there is provided a preferably expanded clay lightweight aggregate mass on the underside of an enclosed structure which mass communicates over substantially its entire area in both the floor/slab portion of the building being supported and heated or cooled as well as the earth therebelow. The aggregate material of the mass has a high "R" factor and is itself a poor conductor of heat. Air is blown from the inside of the generally enclosed structure through an opening in the floor portion thereof to the aggregate mass and circulated through the aggregate mass. Heat is transferred between the circulated air and the earth below the aggregate mass and between the circulated air and the slab/floor above the aggregate mass. Water is excluded from the aggregate mass and thus except for some condensation which may occur in humid climates with cool circulated air, the mass is maintained in a substantially anhydrous condition. To this end, water of condensation, if any, is drained from the mass substantially as it is formed. Circulation air is collected in the aggregate mass and distributed to the interior of the building in a plurality of preferably balanced flow independent air return lines.

Means can be provided for collecting heat from various heat producing elements within the structure, such as fireplaces, dryers, ovens, stoves, space heaters, and the like. Such collected heat in the form of heated air can be transferred by means of ducts, conduits, or the like to the blower intake portion for circulation into the aggregate mass where heat transfer will store some of the collected heat in the earth beneath the mass. Heat transfer to the heat conducting slab may also occur.

For best results, a small heating unit such as an electrical heating coil is positioned in the blower unit so that a small amount of heat may be added to the intake air as desired during periods of cold weather. Similarly, it is also desirable, especially in humid localities, to include a small cooling coil in the blower unit so that the circulating air may be cooled somewhat during periods when the exterior temperatures are high. For a home having a living area of about 1000 square feet, a 4-kilowatt heating coil and a one-ton (12,000 btu) cooling coil are entirely sufficient for these purposes.

In another embodiment of this invention a solar collector is associated with the structure so that water, air, or other fluid can be heated by solar energy. The heat collected in this matter can be readily transferred to the air being circulated through the enclosed structure thereby furnishing such additional heat as may be needed or desired in connection with the operation of the system as a whole.

Still another aspect of this invention is a method for supporting and enabling heat transfer for a generally enclosed structure. This method comprises (a) supporting on a ground site for the structure a substantially non-heat conductive structurally supportive aggregate mass, (b) enveloping said mass with means for preventing water flow into said mass from the surrounding area, (c) supporting on the enveloped aggregate mass a substantial portion of a slab or floor for said structure, and (d) providing means for circulating air between the interior of the structure and the enveloped aggregate mass. When practicing this method, it is particularly desirable to thermally insulate the perimeter of the aggregate mass and the ground site thereunder at least down to the frost line.

Thus, it is an object of the present invention to provide a heat transfer system for homes and like construction which evenly distributes collected heated or cooled air through an aggregate mass for even heat transfer with the earth generally beneath the aggregate mass.

It is another object of the present invention to provide a heat transfer system in which such an aggregate mass furnishes at least a part of the structural support to the building to be heated or cooled.

Another object of the present invention is to provide a heat transfer system which is simple and easy to construct and easy to maintain.

Still another object of the present invention is to provide a heat transfer system which collects wasted heat generated by various heat producing units within the home or like construction such as the fireplace, stove, oven, dryer, and the like, and transfers this heat to a system maintained below the slab or floor thereby maintaining a desirable thermal equilibrium.

A further object of the present invention is to provide an apparatus for collecting wasted heat within the home and transferring the excess wasted heat in the form of heated air to a blower for transfer to a body of air being continuously circulated between a continuous void air space, partially occupied by an aggregate mass provided beneath the home, and the interior of the home.

Yet another object of the present invention is to provide an insulated thermal cap between the home to be heated and cooled and the earth beneath the frost line whereby heat can be added or taken away from the relatively constant temperature earth beneath the home as needed.

It is a further object of the present invention to provide an air circulation medium beneath the home and communicating with the slab/floor portion to maintain a desirable temperature in the slab/floor region.

Still another object of tne present invention is to provide a heat transfer means which is easy to construct and which evenly transfers and distributes heat without excessive hot spots or localization of heat buildup.

It is another object of the present invention to provide a thermal cap heating and cooling construction for use with homes and like constructions which reduces the cost of heating and cooling of the structure and saves energy and money as compared with conventional heating and cooling systems.

Yet another object of the present invention is to provide a heating and cooling transfer system which eliminates attic duct work as provided in conventional heating and cooling systems.

It is a further object of the present invention to provide a heat exchange system which can incorporate a fire alarm, fire prevention system, and purification and/or deodorizing system for use with an overall air circulation system.

It is still a further object of the present invention to provide an air circulation path which moves through a controlled temperature circulation medium at or near an ideal comfortable temperature level, negating the chance for undesirable heat or cooling loss to the ambient air.

Still another object of the present invention is to provide an air circulation system useful during both cold winter and hot summer outdoor environments.

Yet another object of the present invention is to provide an air circulation system featuring a non-conductive circulation medium which baffles air flowing therethrough to maximize air detention time and thus maximize heat storage capability while minimizing the chance for hot spots, convection currents and the like.

A feature of the present invention is that the slab/floor of the home is warmed (in winter) or cooled (in summer) giving comfort to the feet, and lower extremities of the habitant.

Another feature of the present invention is the warming/cooling in winter/summer respectively of fixtures resting on the slab/floor as such is kept at a pleasing temperature level.

Another feature of the present invention is that heat surges from intense heat generation sources as stoves, ovens and the like are quickly dissipated.

Another feature of the present invention is that the system may be installed during home construction with little or no cost increase.

These and other objects and features of this invention will be apparent from the disclosure herein.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

It will be appreciated that most of the foregoing Figures are schematic in character and thus are not in scale.

DETAILED DESCRIPTION OF THE PREFERRED EMBODIMENT

Figure 1:
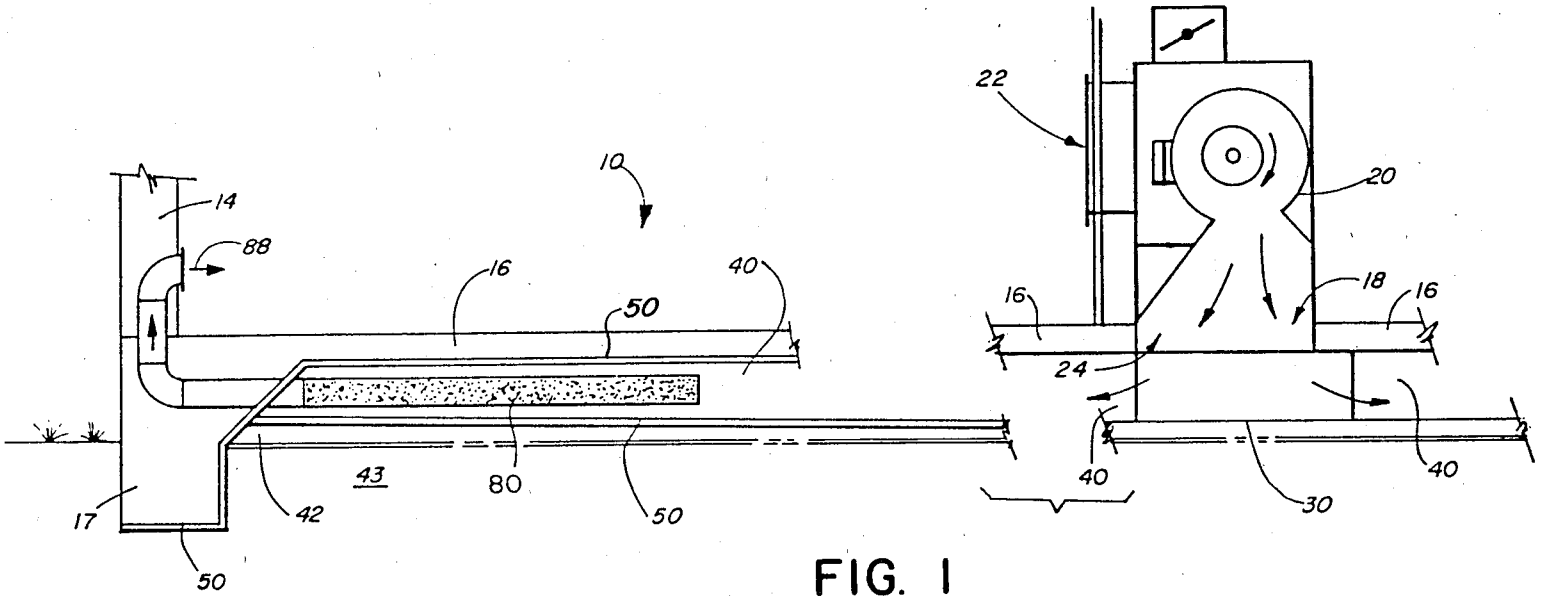
FIG. 1 is a partial sectional view of preferred apparatus of the present invention illustrating the blower, circulation medium, and return air line portions thereof.
Figure 4:
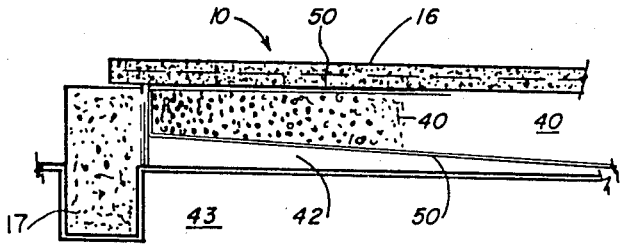
FIG. 4 is a sectional view along line 4—4 in FIG. 3.

FIGS. 1 and 4 provide a partial sectional view of the preferred embodiment designated generally by the number 10. In FIG. 1 there can be seen a home or other generally enclosed structure having wall 14 portions, and slab 16 portion, both in partial view. It should be understood that walls 14 and slab 16 are only partially shown for illustration and the enclosed structure would likewise have a plurality of outer walls, inner walls, a roof and a continuous slab as is known in the art. An opening 18 is provided in slab 16 at blower 20. Blower 20 is provided with intake portion 22 and discharge portion 24. Discharge portion 24 is attached to slab 16 at opening 18 and it will be understood that air is circulated generally from intake 22 through blower 20, and through discharge portion 24 and opening 18 to the area beneath slab 16. A screen box 30 is provided at opening 18 which prevents aggregate mass 40 from blocking or otherwise encumbering the flow of air from opening 18. Perimeter footing or wall 17 furnishes support to slab 16 and serves as a perimeter wall to confine or contain aggregate mass 40 in place.

An expanded clay lightweight aggregate mass air circulation medium 40 is provided beneath slab 16. Preferably, the aggregate has a one half to one and one half inch grain size. When tightly packed together less than 50 percent of the volume occupied by a body or mass of aggregates of this grain size is solid material, the balance being a continuous void air space. The grains are preferably highly irregular having an irregular surface with a surface area approximately double that of a symmetrical or spherical surface of a similar sized particle. Aggregate having a specific gravity of approximately two would be suitable, although the preferred aggregates have even lower specific gravities in the range of about 1.0 to about 1.5. Expanded clay lightweight aggregate medium 40 preferably is relatively non-absorbent to moisture and non-toxic as well as odorless. A 5 percent activated charcoal content could be added for enhanced filtration. The aggregate material would have a high "R" factor and be relatively non-conductive to heat. When air is not in motion, the area below slab 16 becomes an insulated area with little heat transfer taking place between slab 16 and soil mass 43 or sand layer 42. A one-third solids to two-thirds air space is a preferred volume specification, although this may vary from aggregate to aggregate. Usually the aggregate will range in solids:air space volume ratios from about 0.25:0.75 to about 0.5:0.5.

Lightweight aggregate for structural concrete or a lightweight aggregate for concrete masonrg units would be suitable as a material for expanded clay lightweight aggregate mass 40. Such a material is referred to in the American Society for Testing and Materials, ASTM standards, especially ASTM Designation C331-64T and ASTM Designation C330-68T. ASTM Designation C331-64T and ASTM Designation C330-68T are specifications incorporated herein by reference. One such material is known in the industry by the name "Gravelite". Many other suitable materials are also available in the marketplace. For best results, the aggregate material should have an "R" factor at least about 50 percent higher than that of crushed rock or gravel which has an "R" factor of about 1.7. "Gravelite" has been found to have and "R" factor of 2.7.

An expanded clay lightweight aggregate mass 40 as above described is highly suitable for structurally supporting a home or other structure including the slab 16 portion thereof. At the same time, such aggregate mass 40 is a suitable filter material having characteristics which provide excellent air purification. A grain size of three quarter inch to one inch allows easy flow of air through mass 40 which is deposited beneath slab 16. In FIG. 1, a mass 40 of expanded clay lightweight aggregate is provided above sand layer 42. Sand layer 42 could be for example a few inches in thickness and provides a further firm base upon which slab 16 and mass 40 can be rested. Sand layer 42 is not essential, but can be used as a grading material to set the desirable slope for film layer 50 which produces proper water flow (once collected by mass 40 and drained by gravity to film layer 50).

Figure 2:
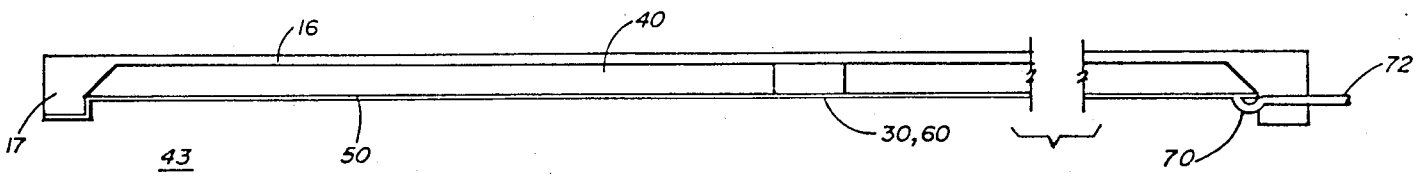
FIG. 2 is a sectional view of the slab portion of a home with the circulation medium and some apparatus of the preferred embodiment shown associated therewith.

A film layer 50 preferably of polyethylene or other suitable water impervious plastic material envelops mass 40 and separates it from slab 16, and from soil mass 43 or sand layer 42. Plastic film sheet envelope 50 is for example made of double thickness six mil plastic film. As indicated in FIGS. 1 and 2 either the upper film sheet 50 or the lower film sheet 50 and preferably both the upper and lower film sheets 50 (note FIG. 16) are extended at their outer edges down into the trench so that they are held in place around the periphery by the footings 17. Naturally, when both the upper and lower sheets 50 are positioned in this manner they are tightly sealed together between the footings and the adjacent earth. It will also be noted from FIG. 1 that the film envelope preferably encompasses and envelops the perforated portion of return line 80 as well as aggregate mass 40. The edges of the upper film sheet 50 are slit at appropriate places so that they will accommodate and can be tucked around the respective return lines 80 as the film sheet are inserted into the trenches into which footings 17 are subsequently poured.

It will be appreciated that the film envelope 50 serves several purposes. By enveloping or encasing the overall aggregate mass 40 the film sheath serves as a barrier against water flowing or seeping into the mass from the surroundings. Secondly, it aids in confining the flow of air to the enlarged continuous void air space within and defined by the aggregate mass. Thirdly, film sheet 50 serves as a protective layer for the aggregate during the pouring of the concrete when forming the slab 16. And fourthly, the plastic film or sheeting serves as a barrier against intrusion by insects.

In a preferred embodiment, circulation mass 40 may be approximately four to eight inches thick at the edge portions and preferably about eight to twelve inches at the center thereof providing a slope to the center. Use of an appropriately graded sand layer 42 is a convenient way of achieving the slope for drainage purposes.

In FIG. 2 there can be seen slab 16, medium 40, and plastic film layer 50 below which would be soil mass 43 or sand mass 42. Note that medium 40 supports slab 16 and communicates therewith. Since air flowing in medium 40 will be at or near an ideal temperature, slab 16 will be heated or cooled accordingly by heat transfer giving a pleasing temperature to floor/slab 16 for walking on, even with bare feet during cold weather.

Figure 5:
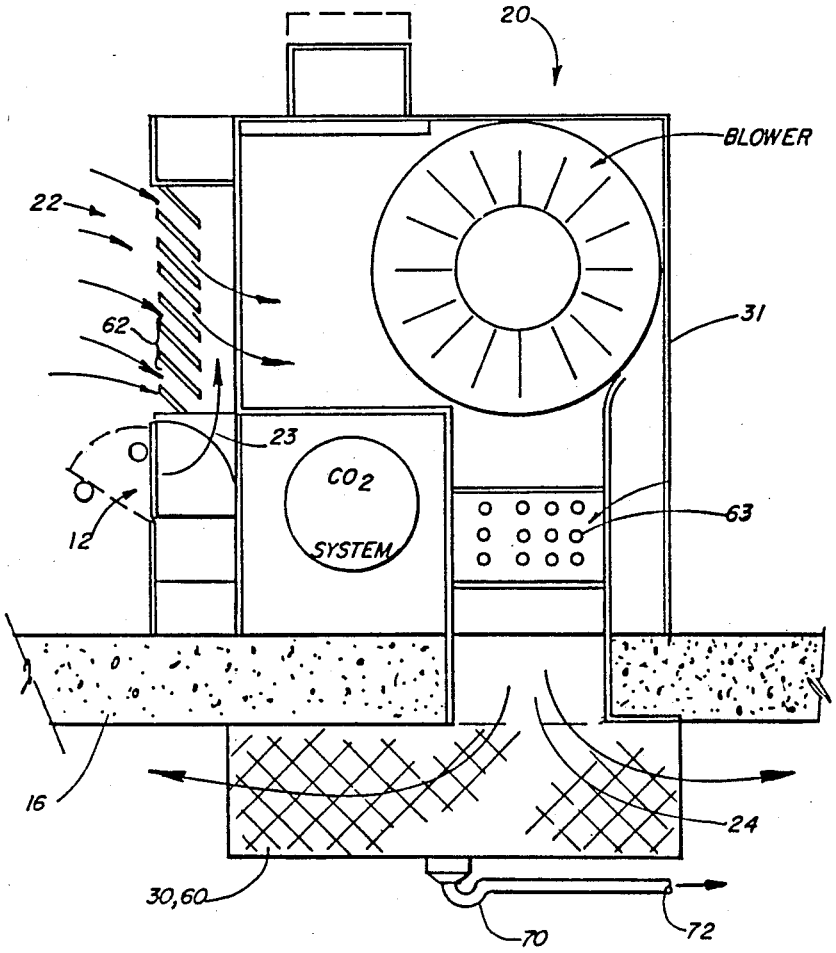
FIG. 5 is a detail of the blower and intake chamber portion of the preferred embodiment.

At the central portion of medium 40 is provided a water drain lintel box 60. In the preferred embodiment, lintel box 60 would be of a screen mesh material which would allow water to drain freely through medium 40 on top of plastic layer 50 to lintel box 60. In the form shown in FIG. 5, the lower portion of lintel box 60 is provided with a drain pipe 70 to discharge water collected therein to the outside portion of slab 16 via conduit 72. As FIGS. 2 and 5 show, lintel box 60 and screen box 30 can be the same unit. FIG. 2 indicates that water may be drained from the lower plastic film sheet 50 by positioning drain pipe 70 at any other suitable location.

Figure 3:
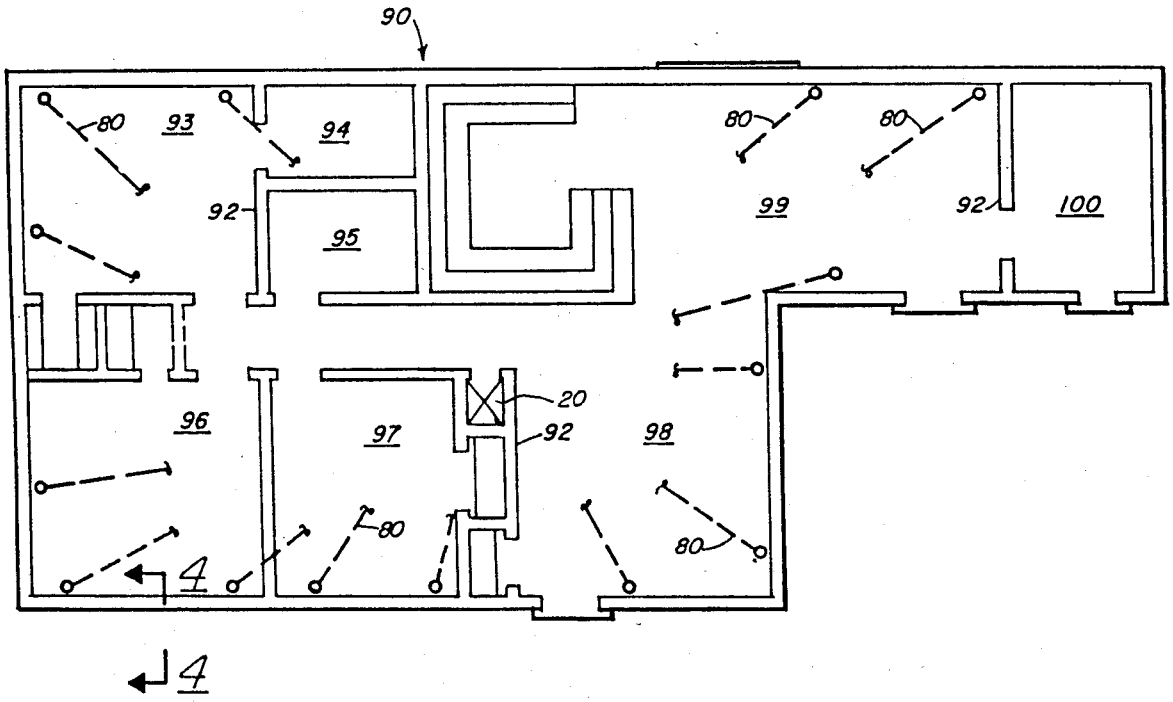
FIG. 3 is a plan view of a typical generally enclosed structure such as a home showing air return line portions of the preferred embodiment and their placement.

In FIG. 3 there can be seen a plan view of a typical home or other generally enclosed structure designated by the numeral 90. In FIG. 3 a plurality of inner walls 92 divides structure 90 into separate rooms 93–100. In FIG. 3, schematically illustrated are a plurality of return lines 80. Each return line 80 is shown as it is placed under slab 16 through circulation medium 40. Lines 80 so placed will allow air to be discharged into structure 90 at desired points and in desired volumes for a balanced air flow system. In FIG. 3 there can be further seen schematically illustrated the placement of blower 20 at the central portion of structure 90. It will be appreciated from the above description that air flow will be generally from blower 20 downwardly through slab 16 and discharge opening 18 through screen 30 to continuous circulation aggregate mass 40. Thereafter, air will intermix with aggregate mass 40 and heat transfer with slab 16 and the underlying earth 43 (as well as sand layer 42, if used) will take place. In addition, the air is filtered as it is blown through mass 40. Since air flow generated by blower 20 will be furnished at for example 1200 to 2000 cubic feet per minute, the openings provided through each air return line 80 will allow for the return of air therethrough as shown by arrows 88 in FIG. 1.

FIG. 5 more particularly shows the construction of blower 20. Blower 20 is housed in a blower chamber 31, which is provided with intake portion 22 and discharge portion 24. Louvers 62 can be provided to control the volume of air intake as desired. A draft box indicated generally by the number 12 can be provided into which may be placed any desirable aromatic, medicinal, air freshener, or like chemical substance which would intermix with air traveling through intake 22 as indicated by arrow 23 in FIG. 5.

As aforementioned, supplementary heat exchange means illustrated as coils 63 are preferably provided at discharge portion 24. In other words, it is preferable to equip blower 20 with a small heating unit and a small cooling unit so that continual or periodic gradual adjustments in the temperatures of the air may be effected as it is being blown into the aggregate mass. These units may be a single combined unit such as a heat pump or they may be separate units. An important feature of this invention is the fact such heating and cooling units may be much smaller than the heating and cooling units required in conventional systems for heating and cooling the same sized building. For example, in the systems of this invention a 5-kilowatt heating coil and a one-ton (12,000 btu) cooling coil are entirely adequate for each 1000 square feet of interior living area in homes constructed in the Gulf Coast region of the United States.

If desired, a carbon dioxide or like gaseous fire extinguisher system could be provided to blower 20 so that the fire extinguishing substance may be injected into the air being blown through opening 18 for subsequent entry into the home in the event of fire. Likewise, blower 20 is a convenient location for a smoke alarm system.

Figure 7:
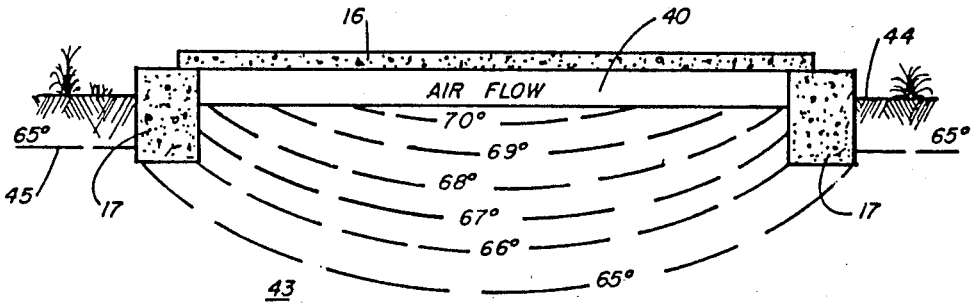
FIG. 7 is a sectional schematic illustration of the thermal cap frost line as related to the preferred embodiments of the present invention.

In FIG. 7 there is seen schematically the thermal cap portion of the preferred embodiment which is provided under slab 16 and above soil mass 43 at ground surface 44. Frost line 45 is also schematically illustrated to indicate that a relatively constant temperature is provided at soil mass 43 for example, of between 65 and 70 degrees Fahrenheit.

It should be understood that soil mass 43 beneath mass 40 will be of relatively constant temperature year round. If desired, an excavation would be made depending on the depth of the frost line in a particular area to provide a space within which circulation mass 40 will be placed. Slab 16 is placed on top of circulation mass 40 and is in part structurally supported thereby. Peripheral walls 17 provide peripheral support to slab 16 and containment of aggregate mass 40 at the side portions.

Thus, an overall thermal cap 10 is provided between slab 16 and soil medium 43 which controls and keeps the temperature of the soil mass 43 relatively constant, as is desirable. Since aggregate mass 40 is structural, it supports slab 16. Since mass 40 is relatively non-conductive, air circulated into mass 40 will heat transfer at soil mass 43 and at slab 16. During periods of high humidity, as in summer months, water may tend to accumulate on individual particles of medium 40 which will be a spot for heat transfer, and some heat transfer will be affected at such particles in that instance. Since the air circulation medium 40 is contained under slab 16 and within peripheral wall 17 and above soil mass 43 and communicating therewith, a relatively constant temperature, thermal cap 10 is provided through which air can be circulated on a year round basis.

Since in the practice of this invention an inventory of air is continuously being circulated from the interior of the structure to the void air space of the aggregate mass and back into the interior of the structure, this circulating volume of air tends to reach a relatively constant temperature by virtue of the heat exchanges taking place between the air and the slab or floor above the aggregate mass and between the air and the supportive earth beneath the aggregate mass. As noted above gradual addition of heat to or gradual withdrawal of heat from the circulating air at blower 20 assists in keeping the air at a desirable temperature level without significant consumption of energy. In conventional systems relatively large quantities of outside air at ambient temperatures are often brought into the structure wherein they are subjected to cooling in summer and heating in winter. For example, if the outside air temperature is zero degrees Fahrenheit, a heating unit must supply the heat necessary for a comfortable indoor temperature. But with the present invention totally ambient outside air is not needed, but rather the blower continuously recirculates air into the relatively constant temperature thermal cap 10 through circulation medium 40. Air circulating through will reach and stay at or near an ideal temperature with very little heat transfer needed—i.e., since the air is not ambient outside air, it only needs to be heated or coo,led to a small extent to maintain the desired indoor temperature.

FIGS. 8A through 8D illustrate a method of constructing preferred embodiments of this invention.

Figure 8A:
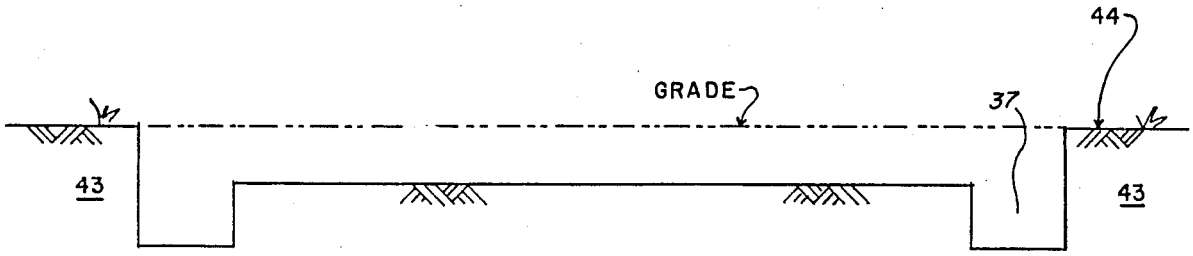
FIGS. 8A, 8B, 8C and 8D are sequential sectional views illustrating a method of constructing preferred apparatus of the present invention.

In FIG. 8A there is seen a soil mass 43 having an upper grade line or grade surface 44. To begin construction of the air circulation system, there is first excavated a cutout 35 having a deeper cut portion 37 at the peripheral edge portions to accommodate peripheral footing or wall 17 as is done in conventional construction to support the outer walls of a generally enclosed structure.

Figure 8B:
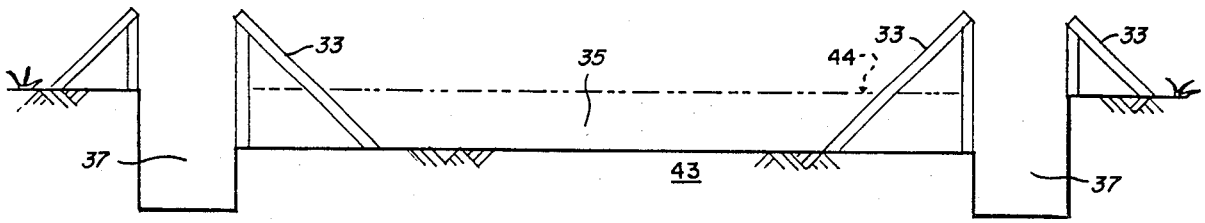

In FIG. 8B forms 33 are provided to contain the concrete for each portion of perimeter footing 17.

Figure 8C:
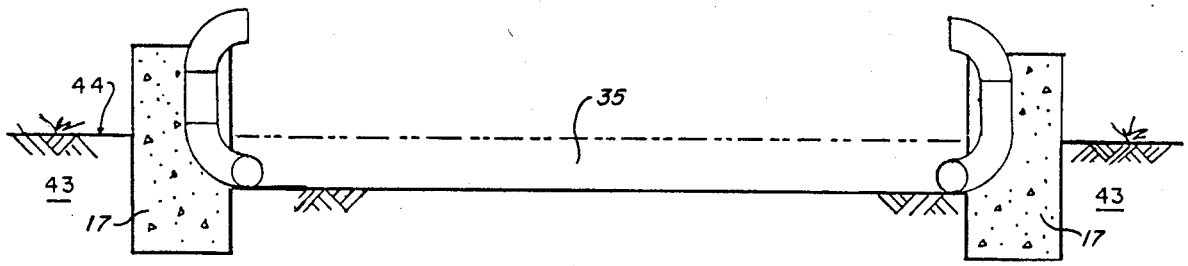

In FIG. 8C footings 17 have been poured, leaving the shallower interior portion of cutout 35 exposed. As will be described more fully hereinafter, this portion of the cutout will be filled with an aggregate mass or medium 40 after it is first lined with for example a film barrier for preventing the ingress or egress of water into or from the medium or mass 40. FIG. 8C also shows that air return lines may be embedded in the footings 17 at suitable locations.

Figure 8D:
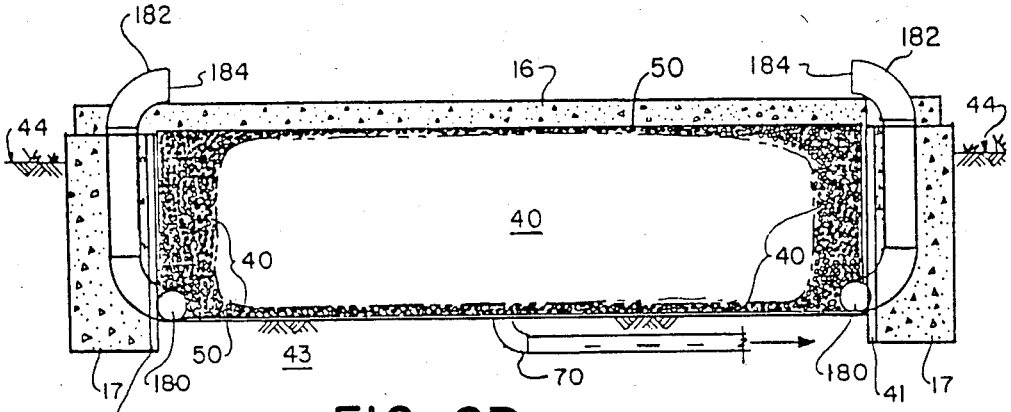

In FIG. 8D insulation, barrier 41 has been added to the inner surface portion of footings 17. It should be understood that insulation barrier 41 will extend around the entire periphery of the footings 17 and that although shown on the interior side of the footings, barrier 41 may be positioned on the exterior side or on both the interior and exterior sides of the footings. Preferably the insulation barrier(s) 41 will extend down to the frost line, if any.

Figure 9:
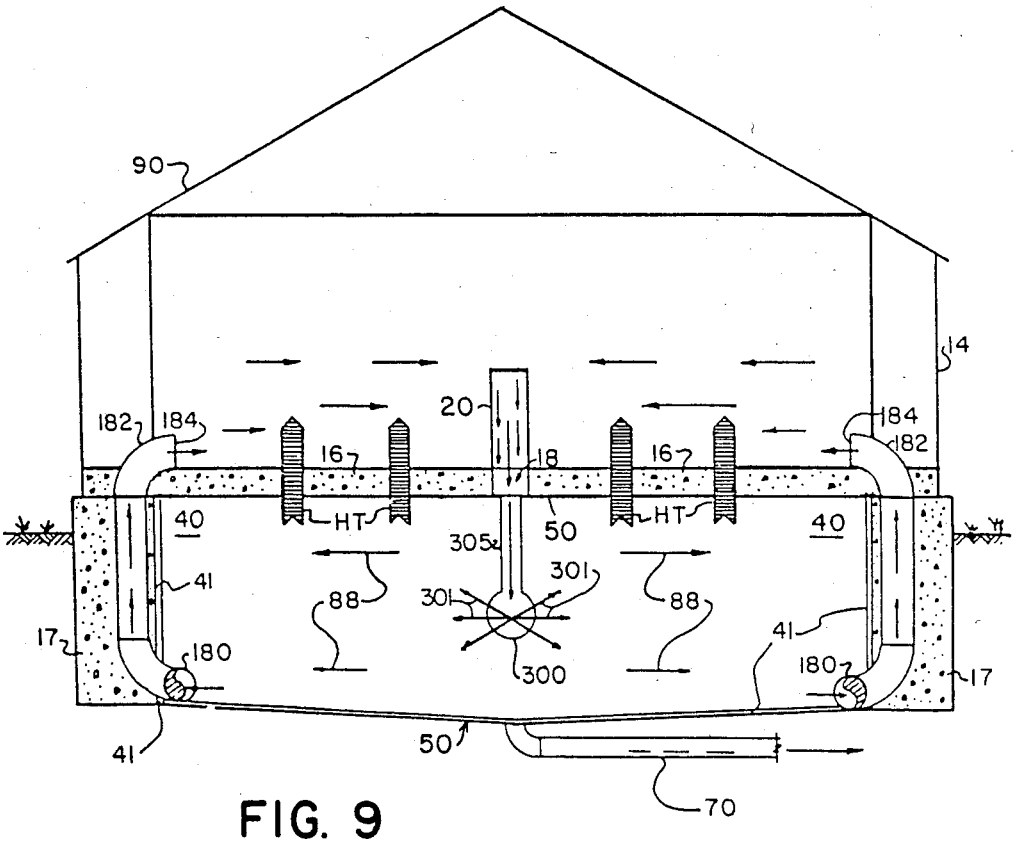
FIG. 9 is an elevational sectional view of preferred apparatus of the present invention illustrating the general air circulation path therewithin.
Figure 10:
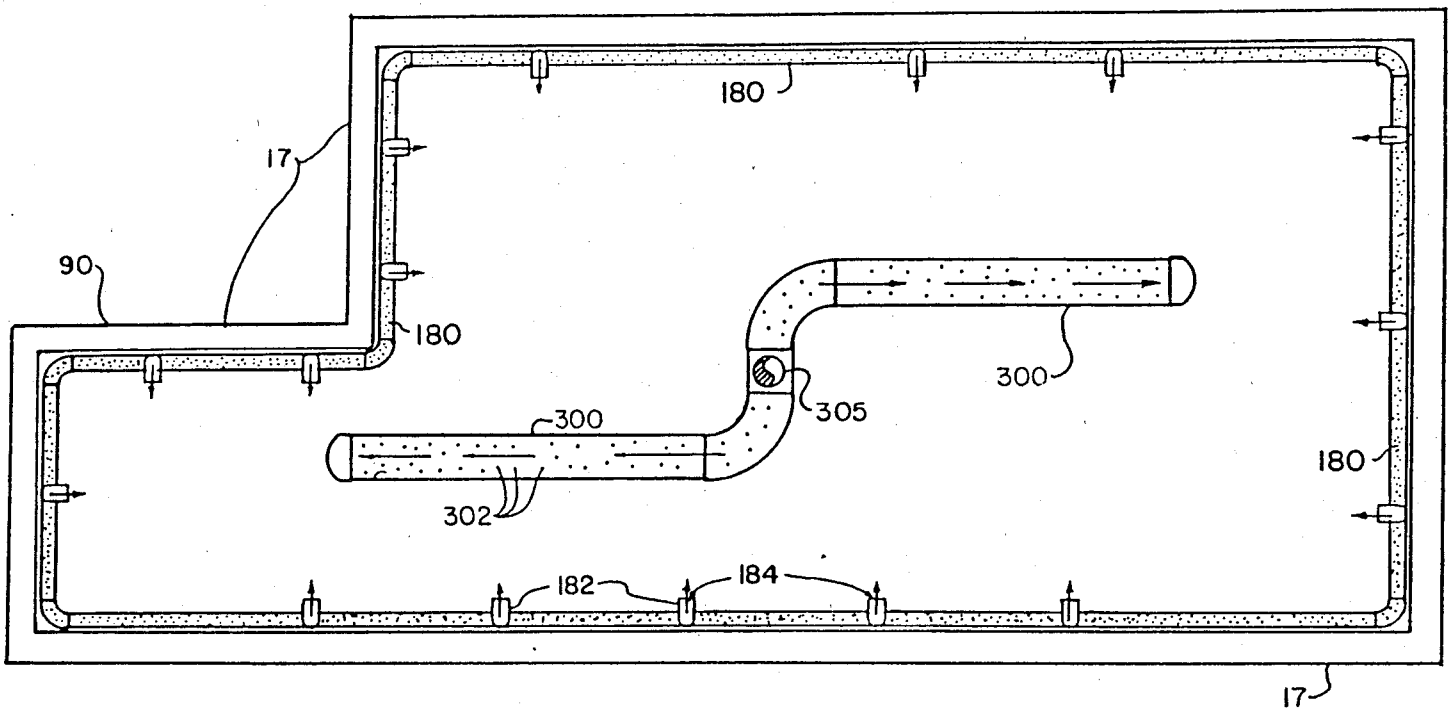
FIG. 10 is a top view of preferred apparatus of the present invention with slab/floor and aggregate removed to expose the air circulation plenum and return air flow portions thereof.

Air return lines 80 may be provided as shown in FIGS. 1 and 3. Alternatively, as depicted in FIGS. 8D, 9 and 10, a continuous perforated header 180 may be positioned around the interior of barrier 41 and footing 17. From continuous peripheral perforated header 180, air is conveyed by branch lines 182 to the interior portion of structure 90.

After the installation of all return lines 80, 180 and any drain line 70, film barrier 50 is installed adjacent the cutout and against insulation barrier 41 and the underlying soil mass 43.

Once the film 50 preferably in the form of a continuous uninterrupted sheet has been installed, aggregate medium 40 as above specified is added to the space between footings 17 as schematically illustrated in FIG. 8D.

Thereafter, another sheet of film 50 is placed over the top of aggregate medium 40 so that the medium is sealed in its film envelope as slab 16 is poured thereover. Thus, FIG. 8D depicts the system after slab 16 has been poured above medium 40 and footings 17. Conventional concrete reinforcement such as reinforcing wire can be utilized as required.

In the preferred embodiment, medium 40 would be placed on either a provided sand layer 42 as shown in FIG. 4 or the underlying soil mass 43, in either case after a lower layer of film 50 has been put in place. Grading as required for sloping water flow to drain 70 is provided—note FIGS. 4 and 9.

FIG. 9 depicts air flow of the preferred embodiments of the invention. Note that air flows generally downward from blower 20 through opening 18 into either lintel box 30 (note FIGS. 1 and 5), or a provided perforated plenum (note FIGS. 9, 10 and 13). As shown in FIG. 10, plenum 300 for example could be a relatively large pipe having perforations 302 and being distributed as required through the central portion of medium 40 to assure a balanced air flow through medium 40 outwardly to perforated peripheral header 180 or to return lines 80. Plenum 300 receives air flow downwardly through vertical shaft 305, and the air passes from the bore of plenum 300 outwardly through perforations 302 as indicated by arrows 301 of FIG. 9 and toward continuous footing 17 as indicated by arrows 88 in FIG. 9 for return air flow through return lines 182. In FIG. 10 slab 16 and medium 40 have been removed to show more clearly the placement of continuous perforated header 180, plenum 300 and return lines 182. In FIG. 9 arrows show the general flow of air from blower 20 downwardly through slab 16 at opening 18 into plenum 300 and outward toward headers 180 and return lines 182 Air is discharged into the interior of structure 90 at discharge openings 184 which can be provided with conventional grill covers equipped with deflectors, or other air flow controllers as is the case with conventional duct air control systems. The fanciful arrows HT indicate the direction of heat transfer across slab 16 when the temperature of the air flowing in aggregate mass 40 is higher than the temperature of the slab itself.

Figure 11:
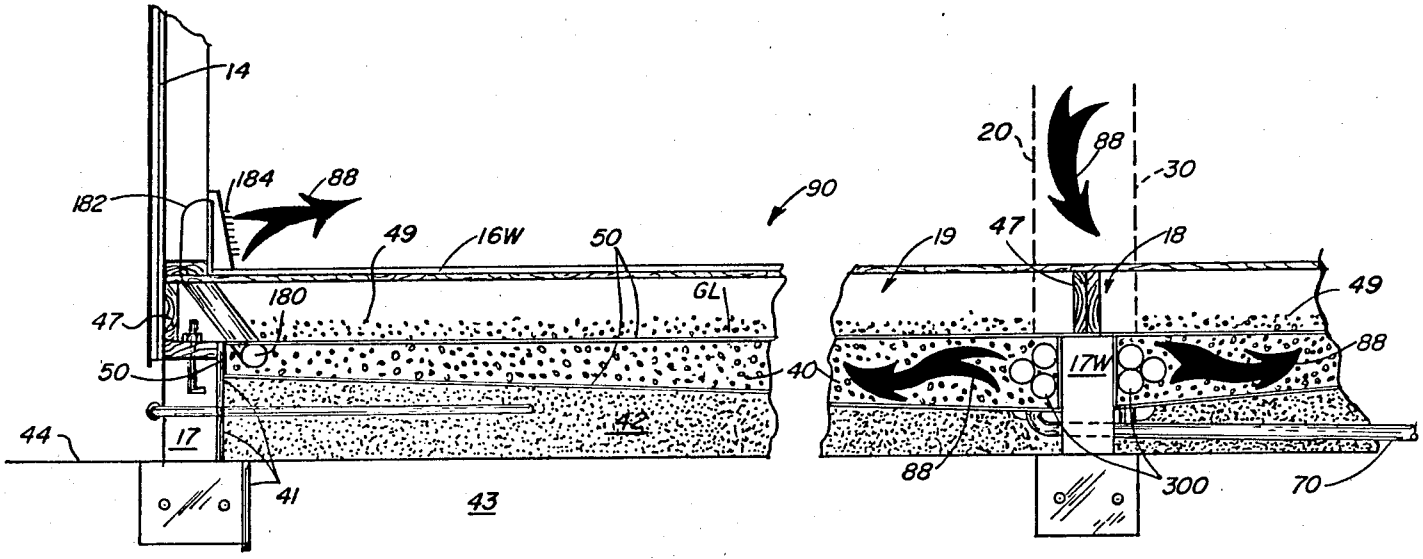
FIG. 11 is a sectional view of a preferred embodiment using a wood floor type building construction.

In FIG. 11 there can be seen a preferred embodiment of the present invention in which a wood floor type home construction is used rather than the slab 16 as above described. The wood floor 16W performs the same function as slab 16 with heat exchange being generally between floor 16W and dead air space 19. Floor 16W is supported above ground level 44 by suitably positioned joists 47 which in turn are supported in place at the perimeter of structure 90 by perimeter footings 17 and at suitable interior locations by interior footings 17W. In other respects the embodiment of FIG. 11 is in accordance with the description given hereinabove. Thus, there can be seen in FIG. 11, aggregate mass 40 encased or enveloped by upper and lower film layers 50; perforated header 180 positioned at the perimeter of aggregate mass 40 around the interior periphery of footings 17 and their adjacent insulation barrier 41; and branch line 182 for conveying air from header 180 to discharge opening 184. Also schematically illustrated in FIG. 11 is blower 20. Plenums 300 receive air flow from blower 20 as with the above embodiments, through opening 18. Air circulation is as depicted by arrows 88 and is similar to the air circulation of FIG. 9.

In the embodiment of FIG. 11, an underlying soil mass 43 provides a base for sand fill 42 which can be graded as desired to direct any accumulated water to drain 70. Perimeter footing 17 as well as any intermediate bearing walls 17W can be, for example, of reinforced concrete construction. Wood floor 16W preferably is supported by joists 47 which can be, for example, two inch by eight inch wooden floor joists spaced according to conventional building codes, such as sixteen inches on center. As noted above, aggregate mass 40 is enveloped by film sheet envelope 50 both above and below mass 50 and on its sides. Insulation 41 sucn as, for example, plastic foam sheets would desirably extend from mass 40 to below the frost line. Dead air space 19 would be provided between floor 16W and mass 40. A layer of, for example, gravel 49 would be used to weight down film envelope 50 on the upper surface of mass 40.

Figure 12:
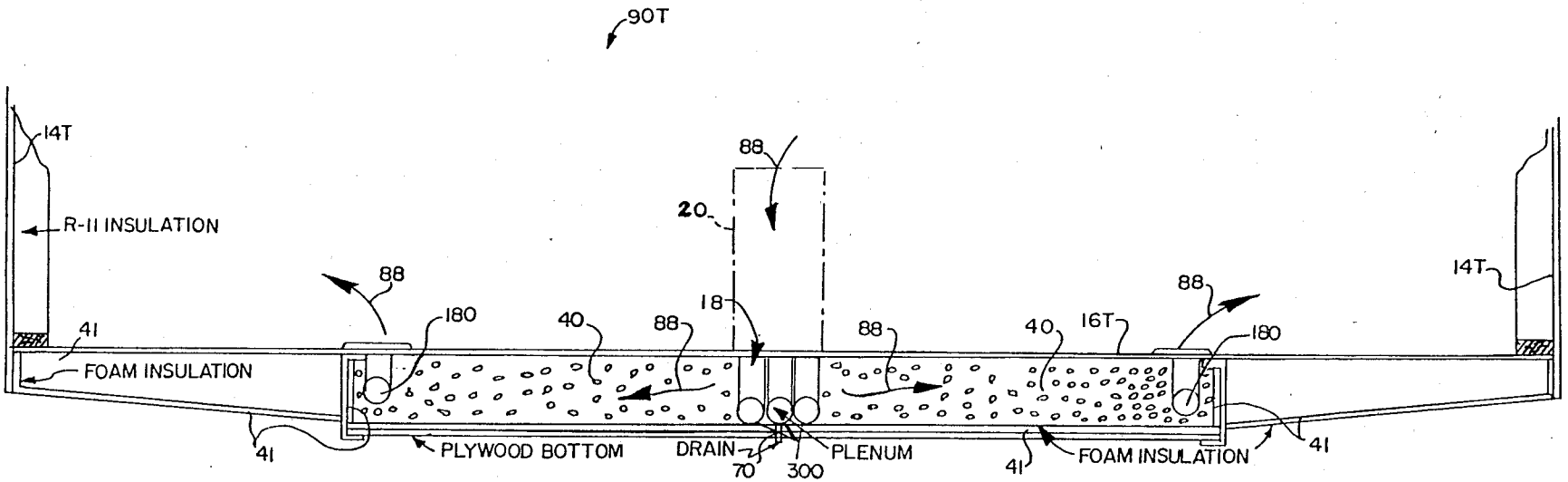
FIG. 12 is an elevational sectional view of preferred apparatus for use with a mobile home or trailer-type home construction.

In FIG. 12 there is depicted a suitable embodiment for use with mobile homes, trailers and the like. Trailer 90T is shown in FIG. 12 as having floor 16T, walls 14T and an inner living space through which air can circulate. Air flow with the embodiment of FIG. 12 is described with respect to FIG. 9 and arrows 88 indicate generally the direction of air flow.

Figure 6:
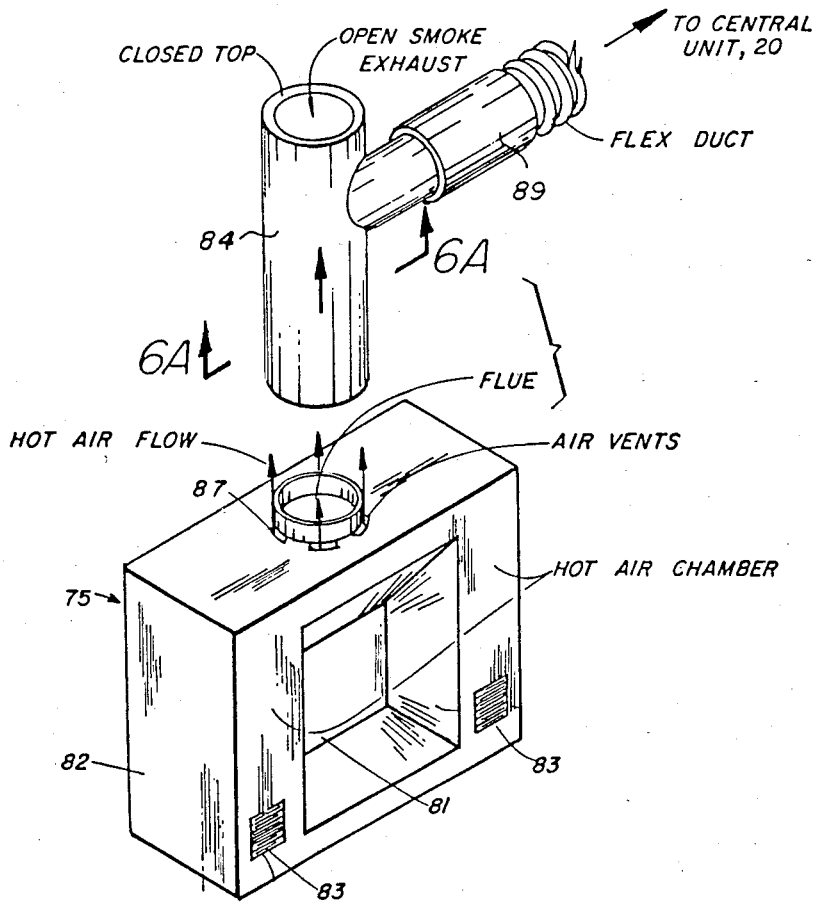
FIG. 6 is a partial perspective view of an excess heat collection unit which may be used with a fireplace.
Figure 6A:
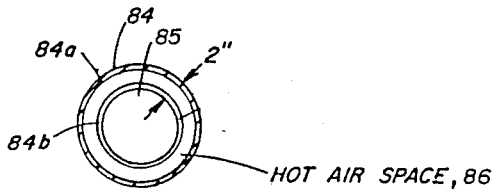
FIG. 6A is a sectional view taken along line 6A—6A of FIG. 6.

FIGS. 6 and 6A illustrate a device wich may be used to further enhance collection of heat which normally would be wasted and to route this collected excess of waste heat to blower 20.

In FIG. 6 there is shown an excess heat collection unit 75 for use with a conventional fireplace. Collection unit 75 provides a double wall casing 82 surrounding a conventional fireplace. Air intakes 83 are provided through which air would be pulled by the force of blower 20 into the inner space of casing 82 and thereafter drawn through openings 87 into double walled flue 84. Flue 84 has an inner **84*b* and outer 84*a* wall construction defining an inner space 85 through which smoke would be exhausted and a hot air space 86 through which the clean air would be pulled. Hot air space 86 has a closed top around the annulus between walls 84*a* and 84*b* and communicates with blower 20 by means of duct 89. Thus clean room air drawn into the inner space of casing 82 via intakes 83 is heated therein by heat transfer from the fireplace and this heated air is passed through openings 87 into hot air space 86 where it is further heated by heat transfer across wall 84*b*. This heated air is then passed to blower 20 via duct 89. Outer wall 84*a* and duct 89** may be insulated so as to reduce heat loss.

Figure 13:
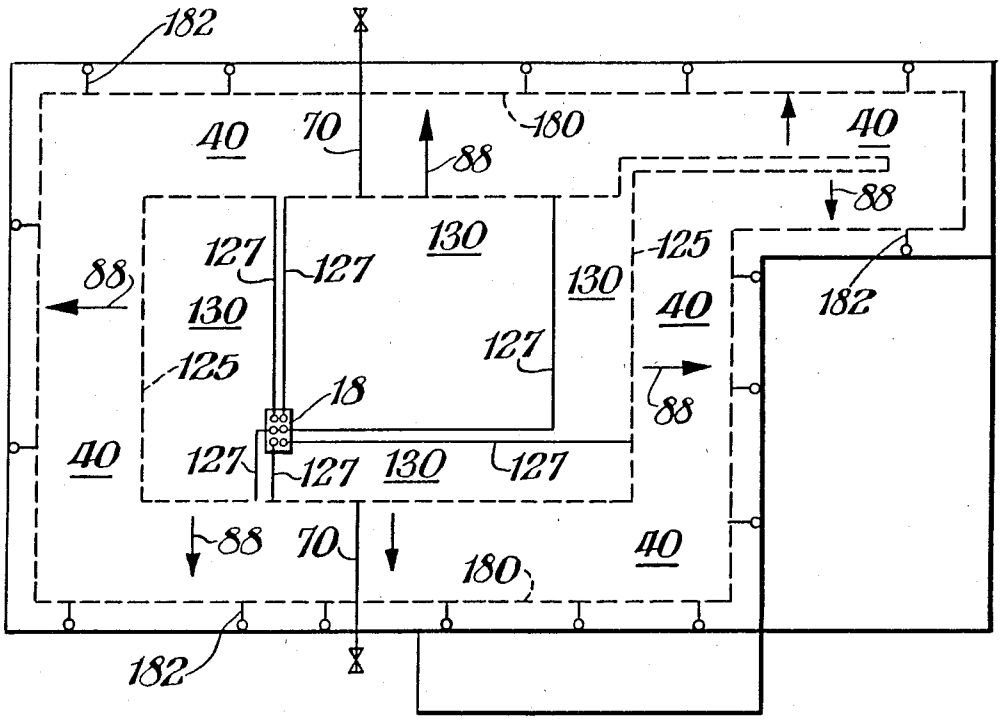
FIG. 13 is a plan view schematically depicting an additional preferred embodiment in which a perforated plenum in the form of a closed loop fed by a plurality of conduits is employed.

FIG. 13 schematically illustrates a preferred embodiment in which a lesser amount of aggregate mass 40 can be successfully employed in the practice of this invention. This embodiment, as in the case of the embodiment depicted in FIG. 10, involves use of a continuous perforated header 180 positioned around the perimeter of aggregate mass 40. Return lines 182 branch from header 180 at appropriate locations around the perimeter of the system and enable discharge of return air to the structure interior at a plurality of locations around its perimeter. However in the case of the embodiment of FIG. 13 perforated plenum 125 in the form of a continuous closed loop serves as the means for distributing the air into aggregate mass 40. Plenum 125 in turn is fed by a plurality of tie lines 127 which receive air from blower 20 (not shown) in the vicinity of opening 18. Tie lines 127 intercept plenum 125 at suitably spaced locations so that the air emanates outwardly from plenum 125 in a substantially uniform flow at all locations around its loop. The flow of air from plenum 125 to header 180 is depicted by arrows 88 and of course aggregate mass 40 is positioned under slab or floor 16 (not shown) in the space between plenum 125 and header 180. With structures having a living area of about 1000 to 1600 square feet, a distance between plenum 125 and header 180 of from about 4 to about 8 feet will usually suffice when the aggregate mass has a depth in the range of about 4 inches to about 1 foot. Within the rectangular area to the interior of plenum 125, a mass of sand, earth or gravel 130 is employed in lieu of the aggregate mass. Consequently, the amount of aggregate used in the system is minimized. Tie lines 127 are embedded in mass 130, and aggregate mass 40 together with plenum 125 and header 180 are encased in film sheet 50 (not shown). Preferably this film sheet envelope is penetrated only by tie lines 127, return lines 182, and drain lines 70. Drain lines 70 extend from the lowermost portions of the encased aggregate mass to an exterior valve or faucet. On opening the valve, water that may have collected with the encased aggregate mass is blown out of the system via lines 70 by virtue of the pressure from blower 20. It will be noted that slab or floor 16 (not shown) is supported in its innermost region by mass 130, at its outermost region or perimeter by footings 17 (not shown) and in the intermediate region therebetween by aggregate mass 40.

Figure 14A:
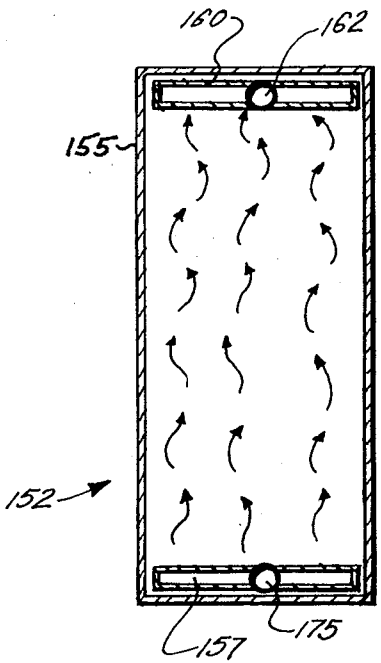
FIG. 14A is sectional view taken along line 14A—14A of FIG. 14.
Figure 14:
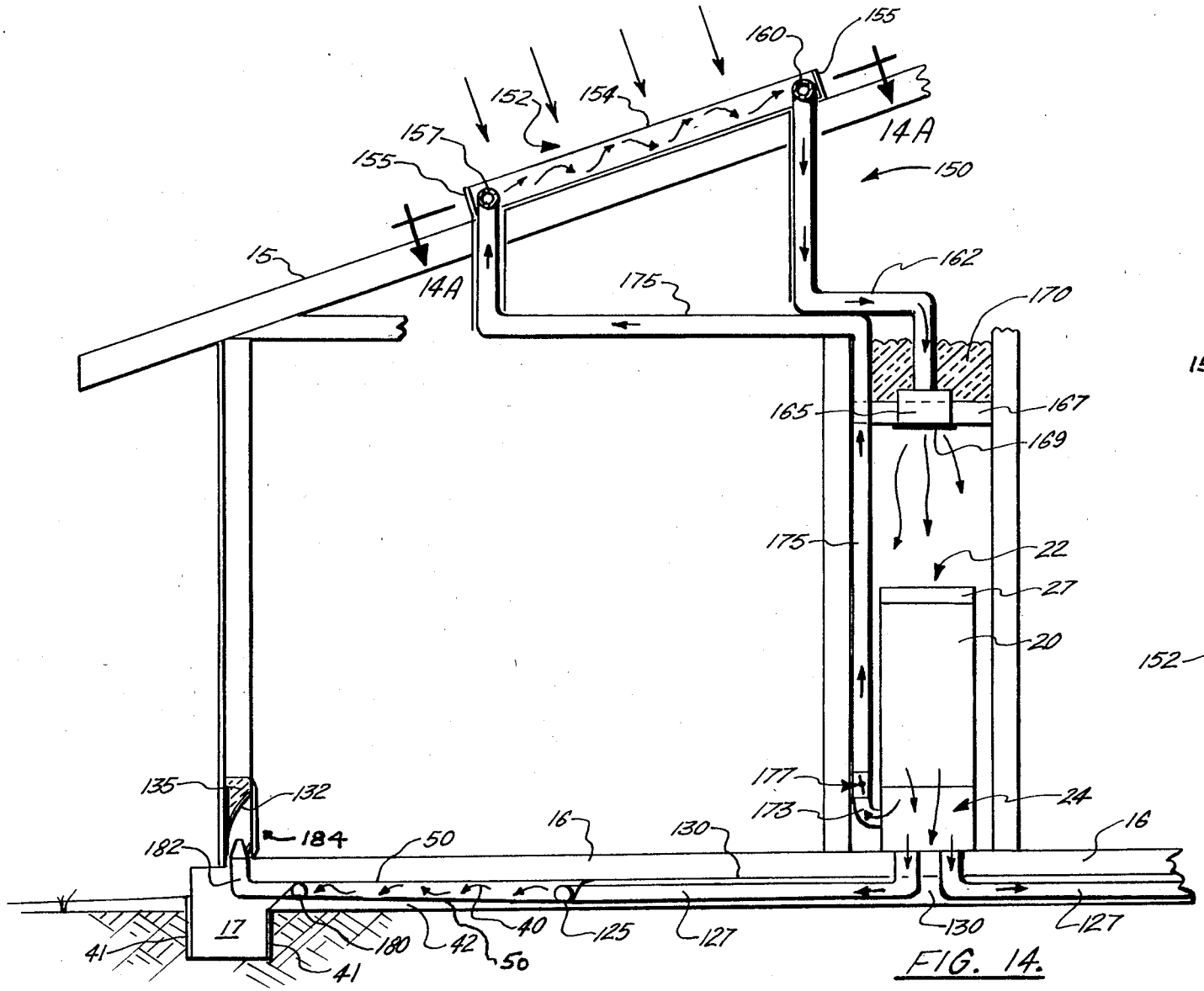
FIG. 14 is an elevational sectional view of a preferred embodiment in which a solar collector is employed in the system of this invention.

A particularly preferred embodiment of this invention involves the utilization of one or more solar collectors in conjunction with systems of the type described hereinabove. This still further reduces the operating cost of the system since solar heat is employed to supply the relatively small quantity of supplemental heat needed to keep the interior at a pleasing temperature even during periods of very cold weather. A preferred system for this purpose is depicted in FIGS. 14 and 14A. The depicted system employes a slab support and sub-slab air distribution and air return combination of the type schematically illustrated in FIG. 13.

Thus FIG. 14 shows slab 16 supported around its perimeter by footings 17 and at its interior region by earth, gravel or sand mass 130 (preferably sand) in which are embedded tie lines 127 for carrying air from blower 20 into perforated plenum 125 in the form of a continuous closed loop positioned around the perimeter of mass 130. Continuous perforated header 180 extends around the perimeter of aggregate mass 40 which is positioned in the hollow rectangular zone defined at its exterior by header 180 and at is interior by plenum 125 and thus slab 16 is supported at these intermediate portions by aggregate mass 40. Return lines 182 branch from header 180 at suitable intervals and transmit the return air to the interior of the structure at discharge openings 184 which preferably are covered by a grill or the like (not shown). Deflector plate 132 backed by thermal insulation 135 deflects the returning air inwardly through opening 184. Thermal insulation barriers 41 are shown positioned on both sides of footings 17 and of course extend around the entire base perimeter of the structure. Plastic film sheet 50 envelops aggregate mass 40, plenum 125 and header 180 and the upper and lower outer edges of film sheet 50 extend down and under footings 17 and are thus sealed together between the footings and the adjacent soil. These edges may extend downwardly on either side of the inner insulation barrier 41. Sand layer 42 between soil mass 43 and tne encased aggregate mass 40 is sloped downwardly toward the interior so that water of condensation with the encased mass will flow toward drain pipes 70 (not shown).

Used in combination with this system is the solar collector assembly depicted generally by the numeral 150. The assembly 150 is composed of an air-tight casing 152 preferably made of weather-resistant metal or plastic which is shown supported on roof 15 but which of course may be positioned at any other suitable location exposed to sunlight radiation. The outer face of casing 152 is fitted with one or more glass panes 154, preferably of the non-reflective type. Walls 155 of casing 152 are preferably lined with thermal insulation material. Positioned at opposite ends or sides within casing 152 are perforated conduits 157, 160 both having closed ends. Within casing 152 conduit 157 serves as the air discharging member and conduit 160 serves as the air receiving member. Return line 162 extends from conduit 160 to air vent unit 165 supported above blower unit 20 by support member 167 which serves as the ceiling of the compartment in which blower unit 20 is housed. Vent unit 165 is equipped with adjustable register 169 to regulate the volume of air leaving unit 165. In the form depicted blower unit 20 preferably has its air intake portion 22 positioned on its upper surface and directly below register 169. An air filter 27 is positioned within air intake portion 22 to prevent an excessive amount of dust or the like from being introduced into the aggregate mass 40.

Extending from the lower side of the discharge portion 24 of blower 22 is elbow 173 to transmit air from the blower unit upwardly to perforated conduit 157 via feed line 175. Flow of air in line 175 is regulated by adjustable damper 177. Preferably feed line 175 and return line 162 are insulated to reduce heat loss to the surroundings. In addition, it is desirable to support vent unit 165 in a well (as shown) which preferably is filled or covered with thermal insulation material 170.

The interior of casing 152 is baffled in any suitable fashion so that the air flowing from conduit 157 to conduit 160 has an enhanced opportunity to be heated by the solar radiation transmitted through pane 154. Such baffling is schematically depicted by the serpentining arrows within casing 152. One preferred way of effecting such baffling is to fill casing 152 with a lightweight porous substance most preferably of a dark color, especially black, to improve heat absorption. One such suitable material for this purpose is aggregate of the type used in mass 40 which may be stained black if desired.

It will thus be seen that in this particularly preferred embodiment of the invention there are two interrelated intertwined circulating inventories of air emanating from and returning to blower 20. One such flow involves the air which is blown through aggregate mass 40 and into the interior of the structure at discharge openings 184 and thence back into the blower through intake 22. The other such flow involves the air which is blown through elbow 173 and feed line 175 into conduit 157 and thence across the interior of casing 152 (where the air is heated during exposure to sunlight) into conduit 160 and thence back to the blower unit 20 through intake 22 via return line 162 and air vent unit 165. Since these two circulating inventories of air are merged within the blower unit the temperature of the entire body of air within the structure is gradually and steadily increased by means of the absorbed solar energy until the desired temperature is reached and then by appropriate adjustments in damper 177 and register 169 the desired temperature is maintained within the structure.

If desired, types of fluid other than air could be used in the solar collector assembly such as water, ethylene glycol, or the like but to do so would necessitate utilizing indirect heat exchange to the air within blower 20 (i.e., heat transfer across a boundary surface) rather than the direct heat exchange utilized in the above-described system. A further advantage of using air is that a system using air is lighter in weight than systems using liquids and the consequences of leakage within the system are much less severe in the case of a circulating air solar system. Lower cost is still another advantage.

Figure 15:
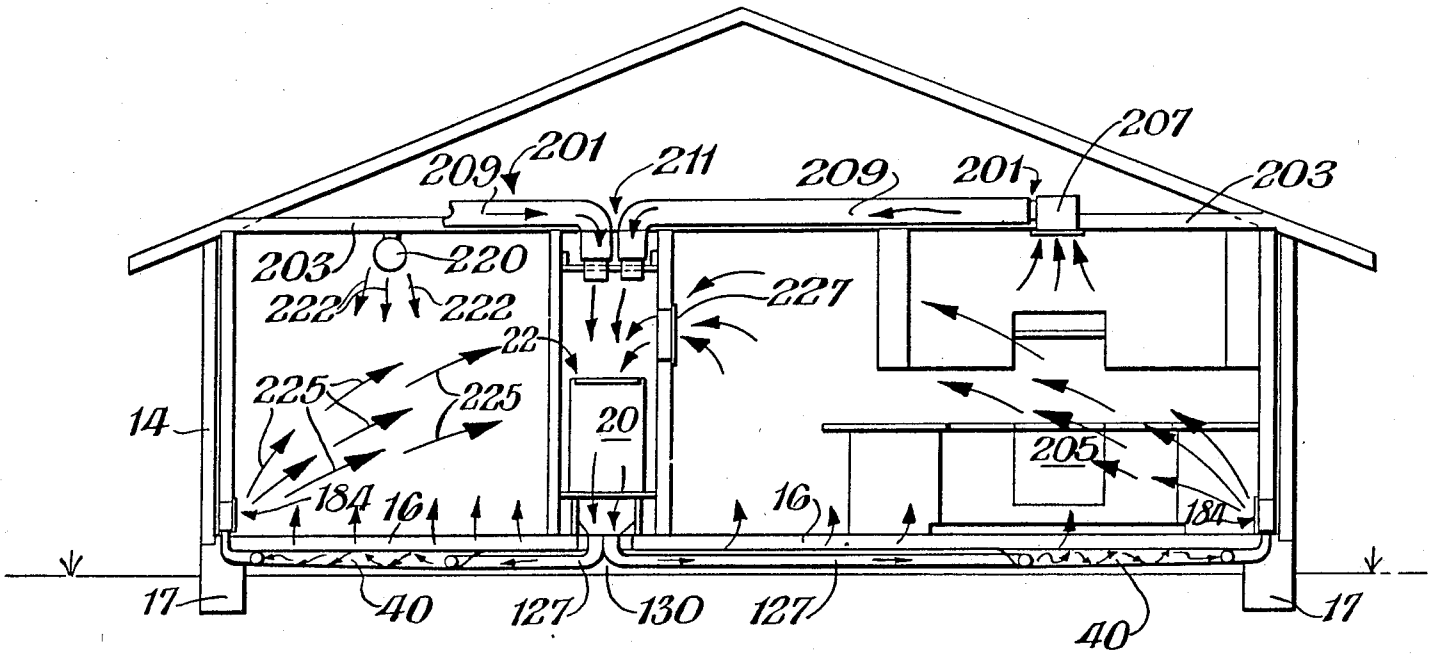
FIG. 15 is sectional elevation of an enclosed structure equipped with preferred apparatus of this invention and illustrating air flow patterns involved.

FIG. 15 depicts a generally enclosed structure equipped with a slab support and sub-slab air distribution and air return combination of the type schematically illustrated in FIG. 13 in which a preferred type of system for recovering waste heat is employed. This heat emanates from such sources is kitchen ranges, stoves and ovens, fireplaces, clothes dryers, electric light bulbs, hot water heaters and the like. By virtue of the air circulation patterns utilized in this embodiment heated air from all such sources is captured to a large extent and introduced into the aggregate mass 40 so that heat transfer with slab 16 above mass 40 and with soil mass 43 below mass 40 is able to occur. The arrows emanating from slab 16 in FIG. 15 depict the situation as it exists when the waste heat is being used in warming the interior of the structure, i.e., heat transfers across slab 16 into the interior so that heating of the interior occurs from the floor area by conduction.

In general, the system depicted in FIG. 15 is essentially the same as that depicted and discussed in connection with FIG. 14 with the exception that the system shown in FIG. 15 does not have a solar collector assembly associated therewith, although such assembly could readily be used therewith if desired. The principal difference between the systems of FIGS. 14 and 15 lies in the overhead heat recovery assemblies of FIG. 15 referred to generally by the numeral 201. Such assemblies are economical to install and are economical and efficient in use.

More particularly, in a suitable position in ceiling 203 above electric range or gas stove 205 is mounted air intake unit 207. Flexible duct 209 is connected to a side opening in unit 207 and extends across the structure above the ceiling to well 211 located at an interior position above blower unit 20. Duct 209 is elbowed downwardly into well 211 and terminates at an appropriate distance above unit 20. The discharge end of duct 209 is preferably equipped with a damper, louvers or other similar mechanism for regulating the amount of air flow. A portion of another similar heat recovery assembly is shown in FIG. 15 which may be used to collect heated air from a fireplace, clothers dryer, hot water heater or other similar heat source. Preferably flexible ducts 209 are thermally insulated and well 211 is filled with suitable insulation material.

As indicated by the arrows in FIG. 15, heated air from range or stove 205 is drawn by blower 20 into unit 207 and through duct 209 into the air intake portion 22 of blower 20 for circulation through aggregate mass 40. Thus the floor is kept warm by heat transfer through slab 16 and the warm air enters the interior of the structure at discharge openings 184 and circulates within the structure as indicated by the arrows. The compartment for housing blower unit 20 preferably has one or more suitably positioned air intake grills 227 to facilitate flow of the circulating air back into the compartment for recirculation by the blower back into aggregate mass 40.

A feature of such internal air rlow is that heated air generated by overhead light fixtures 220 is drawn down into the interior of the structure as indicated by arrows 222 by the flowing curtain of air (depicted by arrows 225) emanating from discharge opening 184 and flowing toward intake grill 227. Thus heat energy from fixture 220 which might otherwise be lost through ceiling 203 is captured and put to good use by recirculation within the system of this invention. By the same token heat energy in the form of warmed air above the slab or floor is captured by the flowing curtain of air depicted by arrows 225 and thus besides keeping the interior at a comfortable temperature this heat energy is not lost to any great extent through the exterior walls 14 or ceiling 203. Rather, it too is recirculated within the system of this invention.

In this connection, model homes equipped with systems of this invention have been maintained at 68° to 70° F. inside temperatures during periods of 20° to 22° F. outside temperatures even without use of a furnace or other conventional heating system. In fact, studies of test results using the system of this invention have indicated that the average annual savings in energy consumption for heating and cooling a home with such system in the Gulf Coast region of the United States will be approximately 78 percent as compared to use of a conventional heating and cooling system for the home. In other words, the energy requirements with the system of rhis invention would only be about 22 percent of the energy normally required to heat and cool the home with a conventional system.

Figure 16:
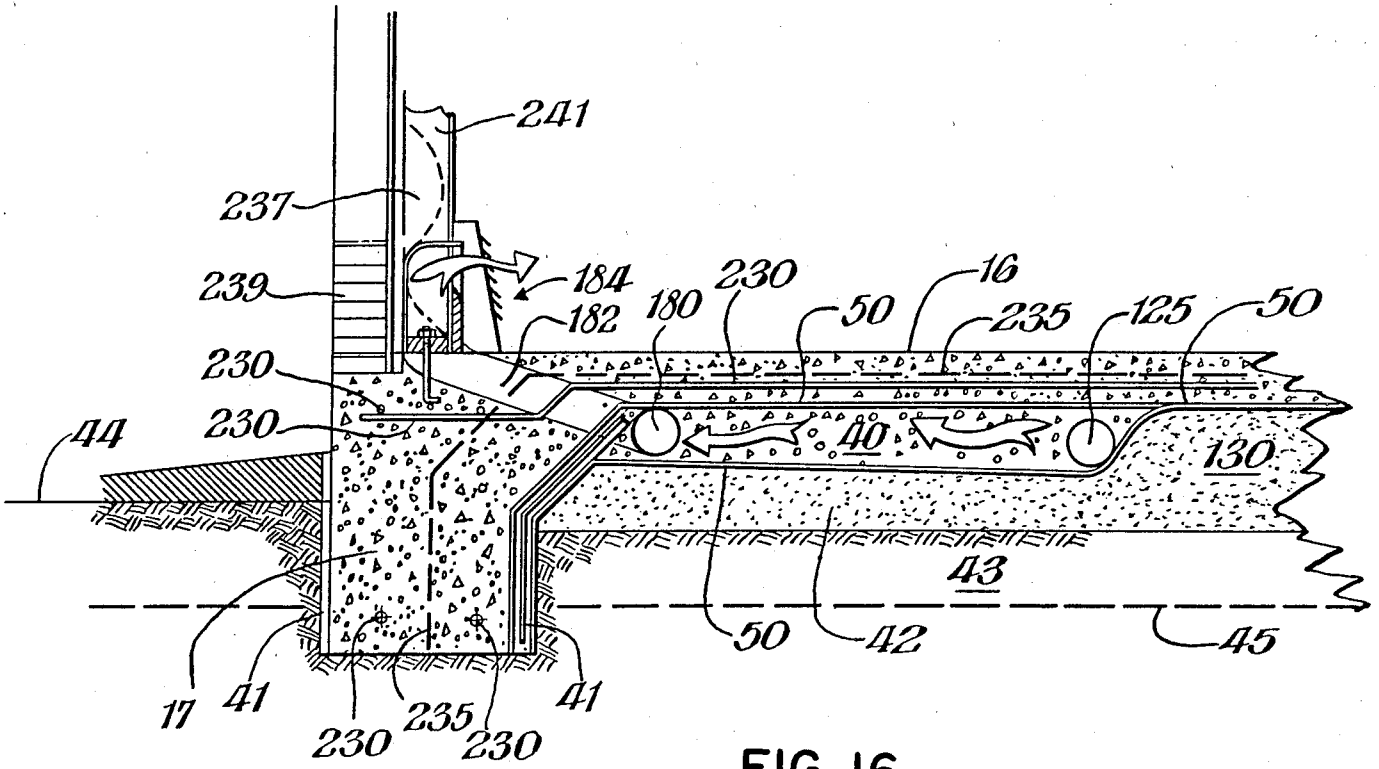
FIG. 16 is an enlarged fragmentary sectional elevation of a preferred construction arrangement for the sub-slab and peripheral wall areas of a structure equipped pursuant to this invention.

FIG. 16 is an enlarged view illustrating in greater detail desirable construction features of the preferred system depicted in FIG. 13. Of particular interest in FIG. 16 is the desirable manner by which aggregate mass 40, perforated plenum 125 and perforated header 180 are encased in the plastic film envelope 50. It will be seen that at least two sheets of film 50 overlie mass 130 preferably composed of sand. The sand is graded as shown to furnish sand layer 42 below aggregate mass 40. At least one such film sheet 50 extends over the top of sand layer 42 and beneath perforated plenum 125, aggregate mass 40 and perforated header 180 to the inner side of interior insulation barrier 41, and then under interior barrier 41 and footing 17. At least one other such film sheet 50 extends from the top of mass 130 and above perforated plenum 125, aggregate mass 40 and perforated header 180 to the outer side of interior insulation barrier 41 against the inner side of footing 17, and then under footing 17. Thus, in this arrangement the sheets are in effect sealed together under footing 17 and above mass 130 (i.e., between mass 130 and slab 16) and encase interior insulation barrier 41 and well as header 180, mass 40 and plenum 125 within the envelope so formed. It will also be noted that in pursuance of preferred practice, insulation barriers 41 are positioned on both the interior and exterior sides of footing 17 and both extend down to below frost line 45. The positioning of aggregate mass 40 above ground level 44 with little or no excavation except for the footings 17 is also illustrated in FIG. 16. Still further, the use of reinforcing rods 230 and wire reinforcement 235 in slab 16 and footings 17, and the use between brick veneer 239 and studs 241 of foamed insulation 237 preferably having a foil backing are shown in FIG. 16.

It is thought that the invention and many of its attendant advantages will be understood from the foregoing description and it will be apparent that various changes may be made in the form, construction, and arrangement of the parts without departing from the spirit and scope of the invention, the forms hereinbefore described being merely preferred embodiments thereof.

What is claimed is:

1. A support and temperature regulating structural system for use with a generally enclosed structure having at least enclosing walls, a roof and a slab/floor, which structural system comprises:

(a) an aggregate mass having void air spaces therein enabling air to pass through said mass;

(b) film sheet enveloping said mass for preventing water flow into said mass from the exterior; and (c) means adapted to direct a flow of air from the interior of said enclosed structure through a substantial portion of the void air spaces of said mass and thence back into the interior of said structure;

said mass being further characterized in that:

(d) said mass together with its film sheet envelope rests upon and is supported by the ground at the site of said structure and is adapted to communicate with and support at least 30 percent of the area of the underside of said slab/floor; and (e) said mass is substantially non-heat conductive particulate expanded clay aggregate;

said system further including footings extending downwardly into the ground at the site of said structure, said footings being positioned and adapted to support the underside of said slab-floor at least around the perimeter thereof

2. A system according to claim 1 further including thermal insulation material extending downwardly into the ground at the site of said structure, said material being positioned around the perimeter of the site of said structure and adapted to thermally insulate said mass around the perimeter thereof.

3. A system according to claim 2 wherein said insulation material extends down at least to the frost line.

4. A system according to claim 1 further characterized in that said means of (c) include perforated conduit means positioned around or in the perimeter portion of said mass for collecting air from the enveloped aggregate mass and transferring the collected air to the interior of the generally enclosed structure at peripheral locations in said interior above but in proximity to the floor area thereof.

5. A system according to claim 4 wherein said perforated conduit means comprise a plurality of independent air return lines perforated along a portion of their respective lengths mounted in said mass at a plurality of locations around the perimeter of said mass.

6. A system according to claim 4 wherein said perforated conduit means ccmprise a continuous perforated header mounted around the perimeter of said mass.

7. A system according to claim 4 further including air distributor means positioned at an interior portion of said mass for distributing air from the interior of the generally enclosed structure into said mass in opposed directions toward said perforated conduit means.

8. A system according to claim 7 wherein said air distributor means is an elongate perforated plenum positioned within said mass.

9. A system according to claim 7 wherein said air distributor means is a perforated plenum in the form of a closed loop fed by a plurality of conduits adapted to receive air from the interior of the generally enclosed structure.

10. A system according to claim 9 wherein (i) said closed loop is positioned around the perimeter of an earth, gravel or sand mass adapted to support an interior portion of said slab/floor, (ii) said plurality of conduits is embedded in said earth, gravel or sand mass, and (iii) said aggregate mass is positioned around the perimeter of said closed loop.

11. A system according to claim 10 further including thermal insulation material extending downwardly into the ground at the site of said structure, said material being positioned around the perimeter of the site of said structure and adapted to thermally insulate said mass around the perimeter thereof.

12. A system according to claim 11 further including a concrete slab supported around its lower perimeter portion by said footings and supported at its lower interior portion by said earth, gravel or sand mass, and supported at its lower intermediate portions between said perimeter portion and said interior portion by said aggregate mass.

13. A system according to claim 7 further characterized in that said film sheet of (b) comprises plastic sheeting positioned above and plastic sheeting positioned below said aggregate mass so as to envelop said aggregate mass, said perforated conduit means and said air distributor means.

14. A system according to claim 13 still further characterized in that the outer edges of the plastic sheeting positioned above and the plastic sheeting positioned below said aggregate mass extend to and are held together by said footings and the ground adjacent thereto.

15. A support and temperature regulating, structural system for use with a generally enclosed structure having at least enclosing walls, a roof and a concrete slab floor, which structural system comprises:

a. a mass of particulate expanded clay lightweight aggregate having void air spaces therein enabling air to pass through said mass;

b. film sheet enveloping said mass for preventing water flow into said mass from the exterior;

c. means adapted to direct a flow of air from the interior of said enclosed structure through a substantial portion of said mass and thence back into the interior of said structure for discharge therein at a plurality of locations around the lower perimeter of said interior;

said mass being further characterized in that d. said mass together with its film sheet envelope rests upon and is supported oy the ground at the site of said structure and is adapted to communicate with and support a substantial portion of said slab; and e. said mass has an R factor of at least 2.5.

16. The system of claim 15 further including said slab.

17. The system of claim 15 further characterized in that said mass has a grain size within tne range of about 0.5 to about 1.5 inches.

18. The system of claim 15 further characterized in that the average vertical thickness of said mass is in the range of about 4 inches to about 18 inches.

19. The system of claim 15 further characterized in that the ground at said site upon which said mass together with its film sheet envelope rests includes a layer of sand.

20. The system of claim 15 further including said slab and footings extending downwardly into tne ground at said site, said footings supporting the underside of said slab around the perimeter thereof.

21. The system of claim 20 further including thermal insulation material extending downwardly into the ground at said site at least down to the frost line, if any, said material being positioned generally adjacent said footings and being adapted to thermally insulate said mass around the perimeter thereof.

22. A temperature control system ror use with a generally enclosed structure having at least enclosing walls, a roof and a slab/floor, said system comprising:

a. a mass of particulate expanded clay aggregate having void air spaces therein enabling air to pass through said mass, said mass being positioned on the site for said structure and adapted to furnish support to the slab/floor thereof;

b. film sheet enveloping said mass for preventing water flow into said mass from said site;

c. means adapted to (i) receive a flow of air from the interior of the enclosed structure and a flow of air from the means of (e) hereinarter specified, (ii) effect heat transfer between the air from said received flows, (iii) distribute a portion of the air into said aggregate mass at at least one generally interior location thereof and (iv) distribute another portion of the air into the means of (e) hereinafter specified;

d. means adapted to receive flowing air at locations around the periphery of said mass and to distribute the air at peripheral locations within the interior of the enclosed structure; and e. means adapted to (i) receive air from said means of (c), (ii) expose said received air to solar radiation to heat the air, and (iii) return the heated air to said means of (c).

23. The system of claim 22 wherein said means of (c) includes a blower which merges said flows of air so that direct heat exchange is effected in the merged air flow.

24. The system of claim 22 further comprising:

(i) a slab/floor supported at an interior portion by said aggregate mass and at its perimeter portion by footings extending down into the earth at said site and surrounding at least said aggregate mass; and (ii) insulation material extending down into the earth at said site and surrounding at least said aggregate mass to minimize lateral heat exchange between tne earth outside the general perimeter of said slab/-floor and at least said aggregate mass.

25. The system of claim 24 wherein said insulation material extends down at least to the frost line.

26. The system of claim 24 wherein said insulation includes plastic foam insulation.

27. The system of claim 22 wherein said means of (d) includes a continuous perforated header mounted around the perimeter of said aggregate mass to receive said flowing air.

28. The system of claim 22 wherein said means of (c) include a perforated plenum in the form of a closed loop for effecting the distribution pursuant to (iii) thereof, said aggregate mass being positioned at least around the perimeter of said closed loop.

29. The system of claim 22 wherein (1) said means of (c) includes a blower which merges said flows of air so that direct heat exchange is effected in the merged air flow;

(2) said means of (d) include a continuous perforated header mounted around the perimeter of said aggregate mass to receive said flowing air;

(3) said means of (c) further include a perforated plenum in the form of a closed loop for effecting the distribution pursuant to (iii) thereof, said aggregate mass being positioned at least around the perimeter of said closed loop; and (4) the space to the interior of said closed loop is occupied at least in part by a mass of earth, gravel or sand adapted to furnish support to said slab/-floor.

30. An aerated thermal cap air circulation apparatus for generally enclosed structures, as a home, said apparatus comprising:

(a) a generally enclosed structure having exterior wall and roof portions which define an inner space to be heated or cooled;

(b) continuous floor means extending over a ground surface structure, said floor means having an upper floor area which during use communicates with said inner space;

(c) an enlarged continuous void air space formed between said floor means and the underlying earth;

(d) a mass of particulate expanded clay lightweight aggregate having a grain size within the range of about 0.5 to about 1.5 inches and an R factor of at least about 2.5 subsurface to said floor means and communicating with an underlying earth which extends to below the frost line, said mass occupying at least partially said air space;

(e) envelope means, surrounding said mass, for confining air flow thereto;

(f) blower means for circulating air between said inner space and said void air space;

(g) air flow conduit means communicating between said void air space and said inner space for balancing air flow between said void air space and said inner space; and (h) insulation means surrounding the perimeter of said mass for insulating said void air space against heat exchange with the surroundings outside the perimeter of said insulation means thereby encouraging heat exchange between said void air space and the underlying earth below said air space.

31. The aerated thermal cap air circulation apparatus of claim 30 further including means for effecting heat transfer with air being circulated to said void air space by said blower means.

32. The aerated thermal cap air circulation apparatus of claim 30 further including solar collector means for adding heat by heat transfer to the air being circulated between said inner space and said void air space.

* * * * *